US008272381B2

(12) United States Patent
Johnson

(10) Patent No.: US 8,272,381 B2
(45) Date of Patent: Sep. 25, 2012

(54) CLOSED CIRCUIT REBREATHER

(76) Inventor: Charles L. Johnson, Clover, SC (US)

( * ) Notice: Subject to any disclaimer, the term of this patent is extended or adjusted under 35 U.S.C. 154(b) by 374 days.

(21) Appl. No.: 12/730,632

(22) Filed: Mar. 24, 2010

(65) Prior Publication Data

US 2010/0242966 A1 Sep. 30, 2010

Related U.S. Application Data

(60) Provisional application No. 61/163,218, filed on Mar. 25, 2009.

(51) Int. Cl.
*A62B 19/00* (2006.01)
*A62B 9/02* (2006.01)

(52) U.S. Cl. ..... 128/205.12; 128/201.27; 128/201.28; 128/204.26; 128/205.24; 128/205.28

(58) Field of Classification Search ..... 128/200.24, 128/200.29, 201.22–201.28, 204.18, 204.21, 128/204.22, 204.23, 204.26, 204.29, 205.11, 128/205.12, 205.22, 205.24, 205.27, 205.28, 128/914
See application file for complete search history.

(56) References Cited

U.S. PATENT DOCUMENTS

| | | | | |
|---|---|---|---|---|
| 4,068,657 | A * | 1/1978 | Kobzan | 128/202.14 |
| 4,964,404 | A * | 10/1990 | Stone | 128/204.22 |
| 5,036,841 | A * | 8/1991 | Hamilton | 128/202.26 |
| 5,092,325 | A * | 3/1992 | Ainscough | 128/201.27 |
| 5,127,398 | A * | 7/1992 | Stone | 128/204.18 |
| 6,581,636 | B2 * | 6/2003 | Carepa et al. | 137/561 A |
| 7,628,153 | B2 * | 12/2009 | Juergensen | 128/204.26 |
| 2005/0072427 | A1 * | 4/2005 | Matsuoka | 128/204.26 |
| 2006/0102176 | A1 * | 5/2006 | Junck | 128/201.11 |

FOREIGN PATENT DOCUMENTS

| | | | |
|---|---|---|---|
| GB | 2462672 | * | 2/2010 |
| GB | 2463308 | * | 3/2010 |

* cited by examiner

*Primary Examiner* — Quynh-Nhu H Vu
(74) *Attorney, Agent, or Firm* — Shumaker, Loop & Kendrick, LLP

(57) ABSTRACT

A closed circuit rebreather including a breathing hose assembly, head assembly and internal counterlung assembly having axial and radial gas flow passageways therethrough, wherein the assembly is housed within a tank and includes a scrubber substantially enclosed along its longitudinal length within a water impervious counterlung bladder, the scrubber including foraminous inner and outer tubes having a carbon dioxide absorbent material filling the space therebetween.

20 Claims, 8 Drawing Sheets

CLOSED CIRCUIT REBREATHER

CROSS-REFERENCE TO RELATED APPLICATIONS

This application claims priority to U.S. Provisional Application No. 61/163,218 filed Mar. 25, 2009 by the present Applicant and entitled "CLOSED CIRCUIT REBREATHER", the contents of which are incorporated herein by reference.

TECHNICAL FIELD AND BACKGROUND OF THE INVENTION

1. Field of the Invention

The present invention relates generally to the field of diving rebreathers, and more particularly, to a closed circuit rebreather (CCR) devoid of an external counterlung and having novel scrubber and valve arrangements, as well as a compact modular design that permits side-mounting of the rebreather, among other features.

2. Background of the Invention

A rebreather is a type of breathing set that provides a breathing gas containing oxygen and recycled exhaled gas. By recycling exhaled gas as opposed to expelling it into the surrounding water, the volume of breathing gas used is reduced, making a rebreather lighter and more compact than an open-circuit breathing set for the same duration in environments where humans cannot safely breathe from the atmosphere.

The main advantage of the rebreather over other breathing equipment is the economical use of gas. With open circuit scuba, the entire breath is expelled into the surrounding water when the diver exhales. A breath inhaled from an open circuit scuba system whose cylinders are filled with ordinary air is about 21% oxygen. When that breath is exhaled back into the surrounding environment, it has an oxygen level in the range of 15 to 16% when the diver is at atmospheric pressure. This results in an available oxygen utilization of about 25%, the remaining 75% being lost.

At depth, the advantage of a rebreather is even more marked. Since the generation of $CO_2$ is directly related to the body's consumption of $O_2$ (about ~99.5% of $O_2$ is converted to $CO_2$ on exhalation), the amount of $O_2$ consumption does not change, therefore $CO_2$ generation does not change. This means that at depth, the diver is not using any more of the $O_2$ gas supply than when shallower. This is a marked difference from open circuit systems where the amount of gas used is directly proportional to the depth.

Other advantages of rebreathers include a reduction of equipment size and weight carried by the diver, conservation of expensive diluent gases, lack of bubbles and bubble noise, minimization of the proportion of inert gases in the breathing mix, minimization of decompression requirements of the diver, and providing breathing gas at a comfortable temperature and moisture content, among other advantages.

Although designs may vary, the major components of a closed circuit rebreather typically include a gas-tight loop, gas source, carbon dioxide scrubber, means for controlling the mix, counterlung and optional casing. The gas-tight loop is the component through which the diver inhales from and exhales into. The loop consists of components sealed together with the diver breathing through a mouthpiece or mask. The mouthpiece/mask is connected to one or more tubes bringing inhaled gas and exhaled gas between the diver and the counterlung, which holds gas when it is not in the diver's lungs. The loop also includes the scrubber, which contains a carbon dioxide absorbent to remove from the loop the carbon dioxide exhaled by the diver. Attached to the loop is at least one valve allowing for the injection of gases, such as oxygen and perhaps a diluting gas from the gas source into the loop. There may also be valves allowing venting of gas from the loop.

Most modern rebreathers also include a system of very sensitive oxygen sensors that allow the diver to adjust the partial pressure of oxygen. This can offer a dramatic advantage at the end of deeper dives, where a diver can raise the partial pressure of oxygen somewhat at shallower depth in order to shorten decompression times, but care must be taken that the PP02 is not set to a level where it can become toxic, as research has shown that a PP02 of 1.6 bar is toxic with extended exposure.

In contrast to conventional closed circuit rebreathers, the particular rebreather disclosed herein is modular and therefore can fit any standard gear configuration adapted to mount a standard AL80 tank. The rebreather disclosed herein is advantageous in that it can be side-mounted and has no external counterlung, making it ideal and safer for diving in narrow, confined passages such as caves and wrecks. The rebreather according to the present invention provides further advantages over the prior art designs including, but not limited to, novel scrubber and valve arrangements, which are described in detail below.

BRIEF SUMMARY OF THE INVENTION

In one embodiment, a closed circuit rebreather is provided herein including: a breathing hose assembly including a breathing mouthpiece, a dive surface valve connected for gas flow with the mouthpiece, a commonly controlled auto demand valve and bail out valve assembly, and an inhale hose and an exhale hose each connected for gas flow with the auto demand valve and bail out valve assembly; a head assembly including a head, an over pressure valve, at least one oxygen sensor, an exhale port connected for gas flow with the exhale hose, and an inhale port connected for gas flow with the inhale hose; and an internal counterlung assembly housed within a tank and including a scrubber assembly positioned within a foraminous outer tube substantially enclosed along its longitudinal length within a water impervious counterlung bladder.

In a further embodiment, the scrubber assembly includes an inner tube having a plurality of longitudinally extending breathing gas flow openings defined therethrough along its length, wherein the inner tube is concentrically positioned within the outer tube by annular washers positioned therebetween to define a volume of space between the inner and outer tubes for maintaining a predetermined volume of carbon dioxide absorbing material.

In a further embodiment, the annular washers and substantially the entire longitudinal periphery of each of the inner and outer tubes are covered with a fine mesh screen having openings sized to prevent a carbon dioxide absorbing material from passing therethrough.

In a further embodiment, the counterlung assembly includes sealing flanges at opposing ends of the outer tube for providing sealing engagement between the bladder and the opposing ends of the outer tube.

In a further embodiment, the counterlung assembly comprises axial and radial breathable gas flow passageways therethrough.

In a further embodiment, the rebreather includes a bottom section of the tank comprising a water drain and a water trap, an oxygen tank for supplying breathing gas and connected for gas flow to the head assembly through an oxygen control valve and inlet hose, and a diluent tank for supplying breathable gas and connected for gas flow to the auto demand and bail out valve assembly through a gas block.

In a further embodiment, the rebreather includes at least one monitor for monitoring the partial pressure of oxygen in the breathing gas.

In a further embodiment, the dive surface valve and auto demand valve and bail out valve assembly are located within a common housing.

In a further embodiment, the internal counterlung assembly is positioned within the rebreather such that it is centrally located to a diver's lungs in either a back- or side-mounted configuration when in use.

In another embodiment, the present invention provides a closed circuit rebreather including: a breathing hose assembly including a dive surface valve, an auto demand valve and bail out valve assembly controlled through a common knob, and inhale and exhale hoses connected for gas flow with the auto demand valve and bail out valve assembly; a head assembly including an over pressure valve, at least one oxygen sensor, an exhale port connected for gas flow with the exhale hose, and an inhale port connected for gas flow with the inhale hose; and an internal counterlung assembly housed within a tank and including a scrubber assembly positioned within a foraminous outer tube substantially enclosed along its longitudinal length within a water impervious counterlung bladder, the internal counterlung assembly having axial and radial gas flow passageways defined therethrough.

In a further embodiment, the scrubber assembly includes an inner tube having a plurality of longitudinally extending gas flow openings defined therethrough along its length, the inner tube being concentrically positioned within the outer tube and defining a volume of space therebetween, and the entire overlapping longitudinal periphery of each of the inner and outer tubes are covered with a mesh screen having openings sized to prevent a carbon dioxide absorbing material from passing therethrough.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
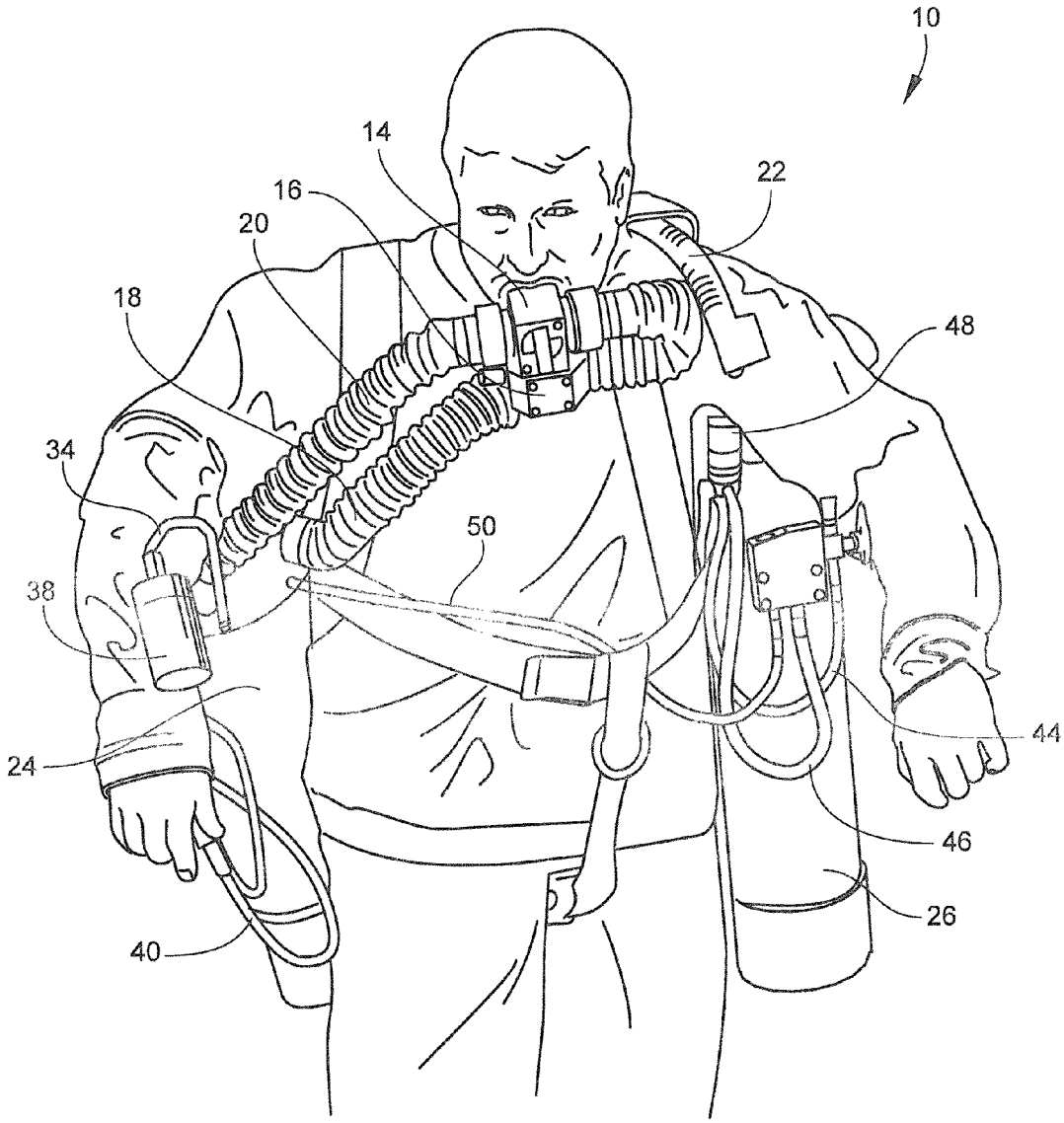
FIG. 1 is an illustration of a diver outfitted with a closed circuit rebreather according to an embodiment of the invention.

The present invention will now be described more fully hereinafter with reference to the accompanying drawing in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Referring now to the drawings, a Closed Circuit Rebreather (CCR) (hereinafter the "rebreather") according to the present invention is shown generally in FIG. 1 at reference numeral 10. For clarity of the invention, the rebreather includes four basic assemblies: a head assembly including a head, Over Pressure Valve (OPV), sensors, sensor wires and PO2 monitors/handsets; a breathing hose assembly including a Dive Surface Valve (DSV), Auto Demand Valve (ADV) and Bail Out Valve (BOV), together with breathing hoses and hose couplings; a counterlung assembly including an outer tube, scrubber assembly, counterlung and related tube hardware; and a bottom section including a water drain, water trap and associated hardware. In addition, an oxygen tank and a diluent tank are connected to the head assembly through hoses and supply breathable gas.

Figure 2:
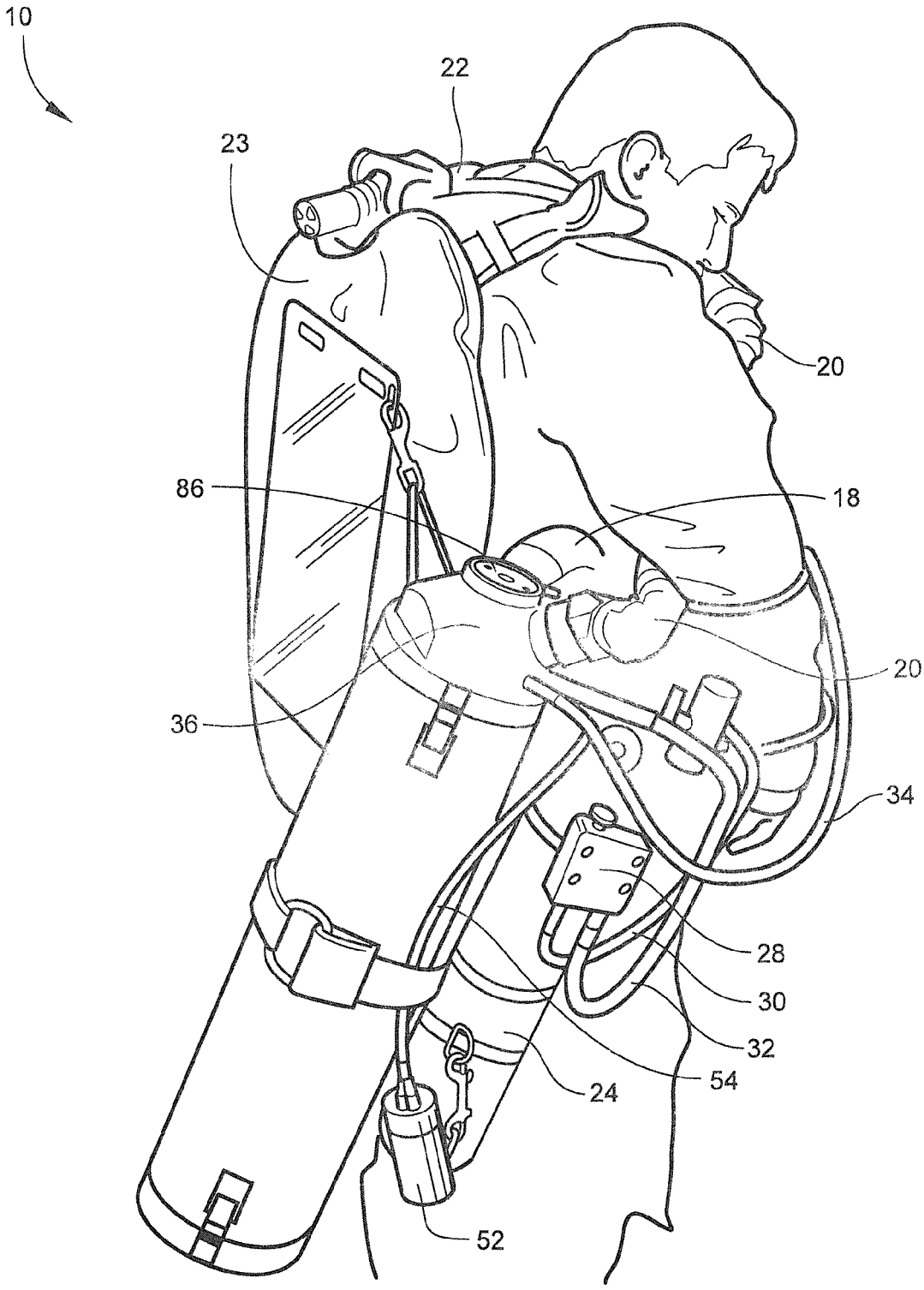
FIG. 2 is a side view of the diver of FIG. 1 wearing the rebreather in a side mount configuration.
Figure 3:
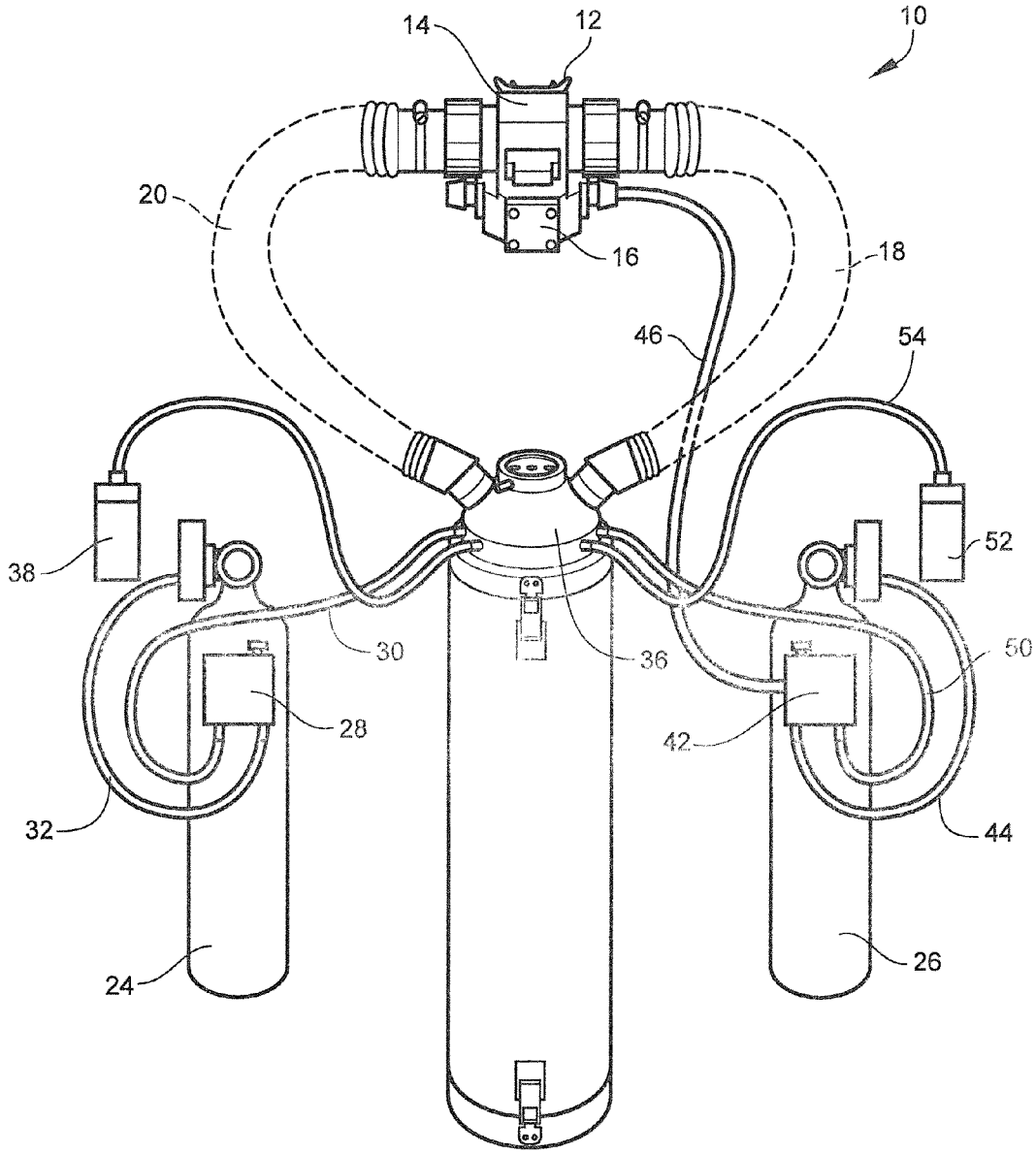
FIG. 3 is an isolated view of the rebreather.
Figure 4:
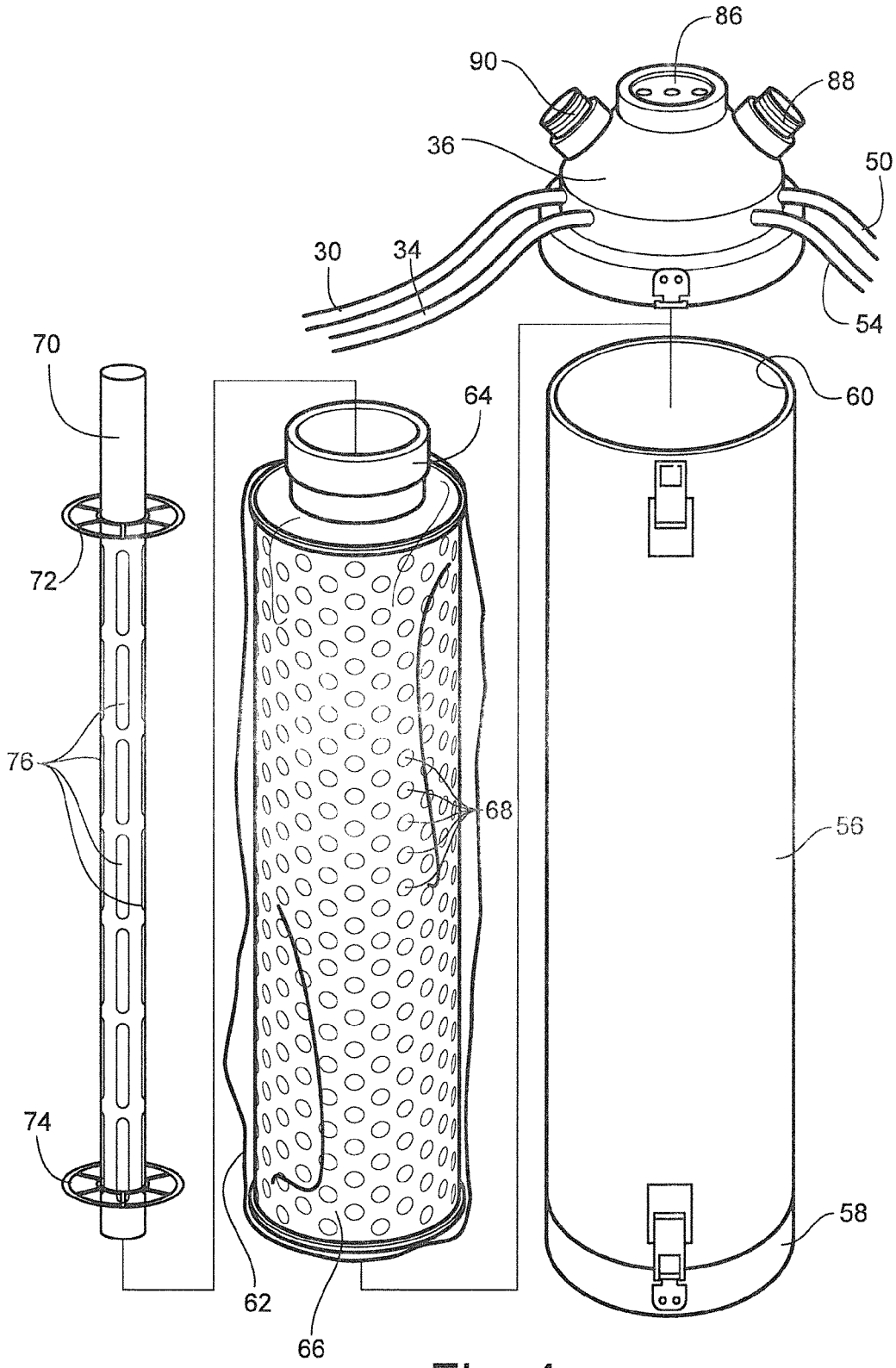
FIG. 4 is an exploded view of the rebreather tank and scrubber assembly.

Referring specifically to FIGS. 1-3, the rebreather 10 includes a soft plastic mouthpiece 12 connected for gas flow to the DSV 14 and the ADV/BOV assembly 16. The assembly shown is a twin hose mouthpiece design, and alternatively may include a breathing mask, where the direction of flow of gas through the loop is controlled by one-way valve assemblies, with the DSV 14 allowing the diver to take the mouthpiece 12 from the mouth while underwater or floating on the surface without allowing water to enter the loop. An inhale hose 18 and an exhale hose 20 communicate for gas flow with the ADV/BOV assembly 16. The rebreather preferably incorporates the DSV and ADV/BOV valves into a simple and compact package, and in one embodiment a common housing, with adjustability of both the ADV and BOV valves with one control knob.

An inflator hose 22 communicates with a Buoyancy Compensator (BC) 23 (see particularly FIG. 2) that functions to control the overall buoyancy of the diver to achieve neutral buoyancy, remain at a constant depth, or to descend or ascend in a controlled manner. As shown, the rebreather 10 is strapped to the side of the diver to provide a "side-mounted" configuration, however, it is envisioned that the compact and modular design of the rebreather allows for alternative mounting positions and configurations. Counterlung position is critical to work of breathing and the diver's trim in the water, thus the internal counterlung herein is centrally located to the diver's lungs in either back- or side-mounted configurations to eliminate or reduce vertical distances between the lungs and counterlung. This counterlung design offers the diver a modular, well balanced, and excellent work of breathing characteristics rebreather.

The diver is shown carrying an oxygen tank 24 and a diluent tank 26 on opposite sides of his body. The oxygen tank 24 includes an Oxygen Control Valve (OCV) 28 with an inlet hose 30 to the rebreather 10 and an inlet hose 32 to the OCV 28 from the valve of oxygen tank 24. The oxygen tank is operable for supplying the oxygen to the loop consumed by the diver. The diluent tank 26 may be filled with compressed air or another diving gas mix such as nitrox or trimix, and is used to reduce the percentage of oxygen breathed and increase the maximum operating depth of the rebreather. In a preferred embodiment, the diluent is not an oxygen-free gas and is breathable, and thus may be used in an emergency situation to either flush the loop with breathable gas or as a bailout.

A wiring cable 34 communicates between the head 36 and a primary Partial Pressure O2 (PPO2) meter 38. Hose 40 connects the rebreather 10 and the oxygen control valve 28. A gas block 42 is mounted on the diluent tank 26, and an inlet hose 44 conveys diluent from the diluent tank 26 to the gas block 42. A feed hose 46 conveys diluent from the gas block to the ADV/BOV assembly 16 through the first stage 48 of the diluent tank 26. A manual add hose 50 passes from the gas block 42 to the rebreather. With particular reference to FIGS. 2-3, a secondary Partial Pressure O2 (PPO2) meter 52 is connected by a wiring cable 54 to the rebreather head 36.

Figure 8:
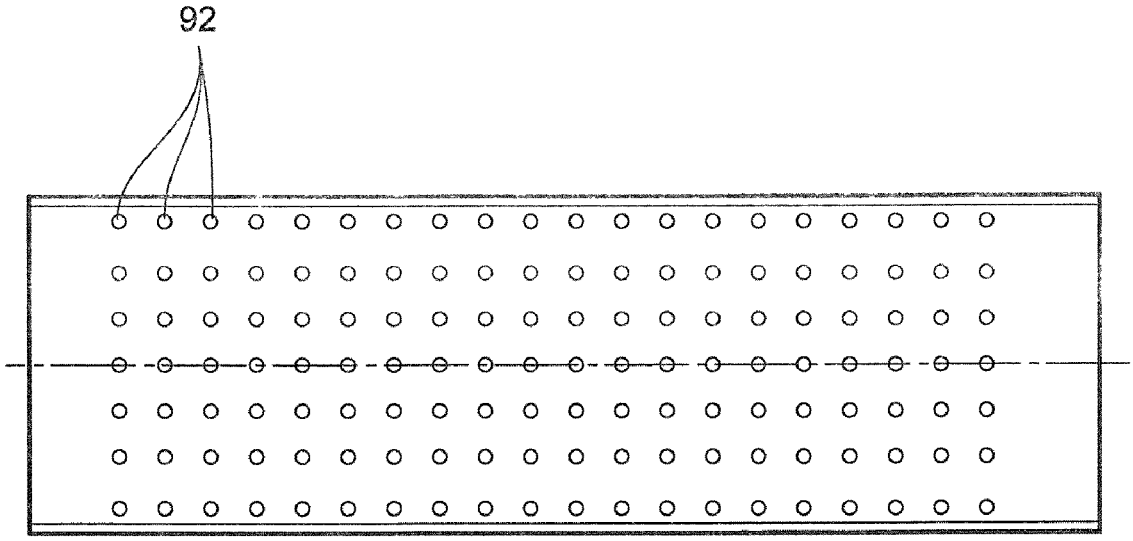
FIG. 8 is an illustration of an alternative hole pattern arrangement of the outer tube of the counterlung.

Referring specifically to FIGS. 4-7, the rebreather 10 includes a rebreather tank 56 with a removable bottom section 58 and the head 36, which is releasably sealed onto the top opening 60 of the tank 56. One key feature of the invention is the internal counterlung, which includes a plastic bladder 62, or bag, that is water impervious and is sealed at its top end to an upper scrubber sealing flange 64 and a lower scrubber sealing flange on its lower end (not shown). The counterlung 62 contains two openings, located at the top and bottom. The sealed top and bottom openings do not permit water to pass therethrough, either from the inside out, or from the outside in. A cylindrical, foraminous tubular scrubber includes an outer tube 66 having a plurality of gas flow openings 68 therethrough defining axial gas flow passageways. The outer tube 66 is substantially enclosed along its longitudinal length within the water impervious counterlung bladder 62. The counterlung is the flexible part of the loop and is designed to change in size by the same volume as the diver's lungs when breathing. Its purpose is to let the loop expand to hold the gas exhaled by the diver and to contract when the diver inhales letting the total volume of gas in the lungs and the loop remain constant throughout the diver's breathing cycle. Referring to FIG. 8, an alternative embodiment of the counterlung housing includes periodically arranged openings therethrough to improve water flow around the counterlung and improve work of breathing. It is envisioned that various opening patterns may be provided to optimize performance.

Figure 5:
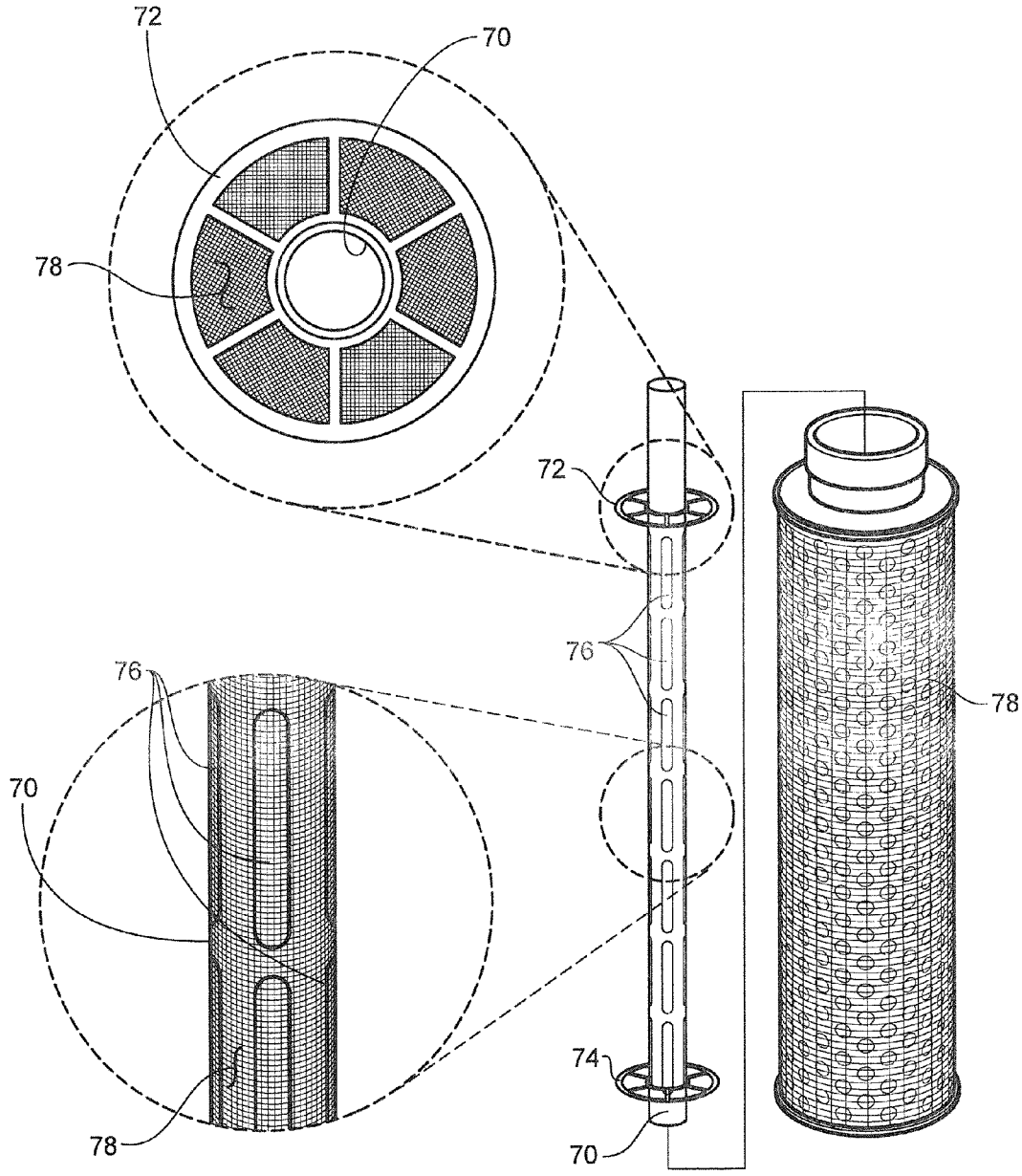
FIG. 5 is a further exploded view of the scrubber assembly including detailed views.

An inner scrubber tube 70 is fitted into the scrubber 66, and is centered and held in its proper concentric position by top and bottom annular washers 72 and 74. As is shown, the inner scrubber tube 70 is perforated with a series of longitudinally-extending exhale flow channels 76. Referring specifically to FIG. 5, the inner scrubber tube 70 is covered with a fine mesh screen 78. Openings in the top and bottom washers 72 and 74 are likewise fully covered by a fine mesh screen 78, and the scrubber 66 is also covered along its entire longitudinal periphery with a fine mesh screen 78.

Figure 6:
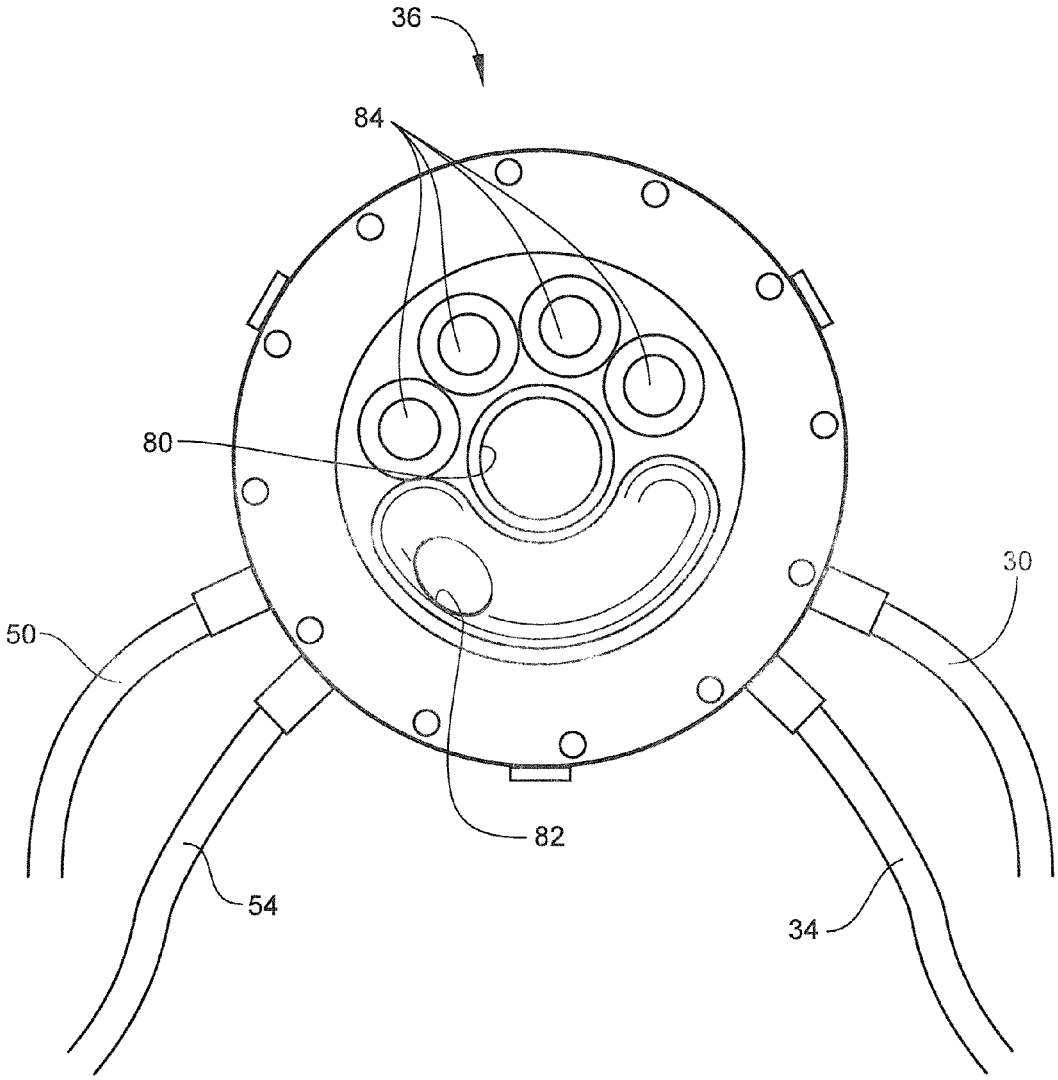
FIG. 6 is a top plan view of the interior of the head assembly of the rebreather.
Figure 7:
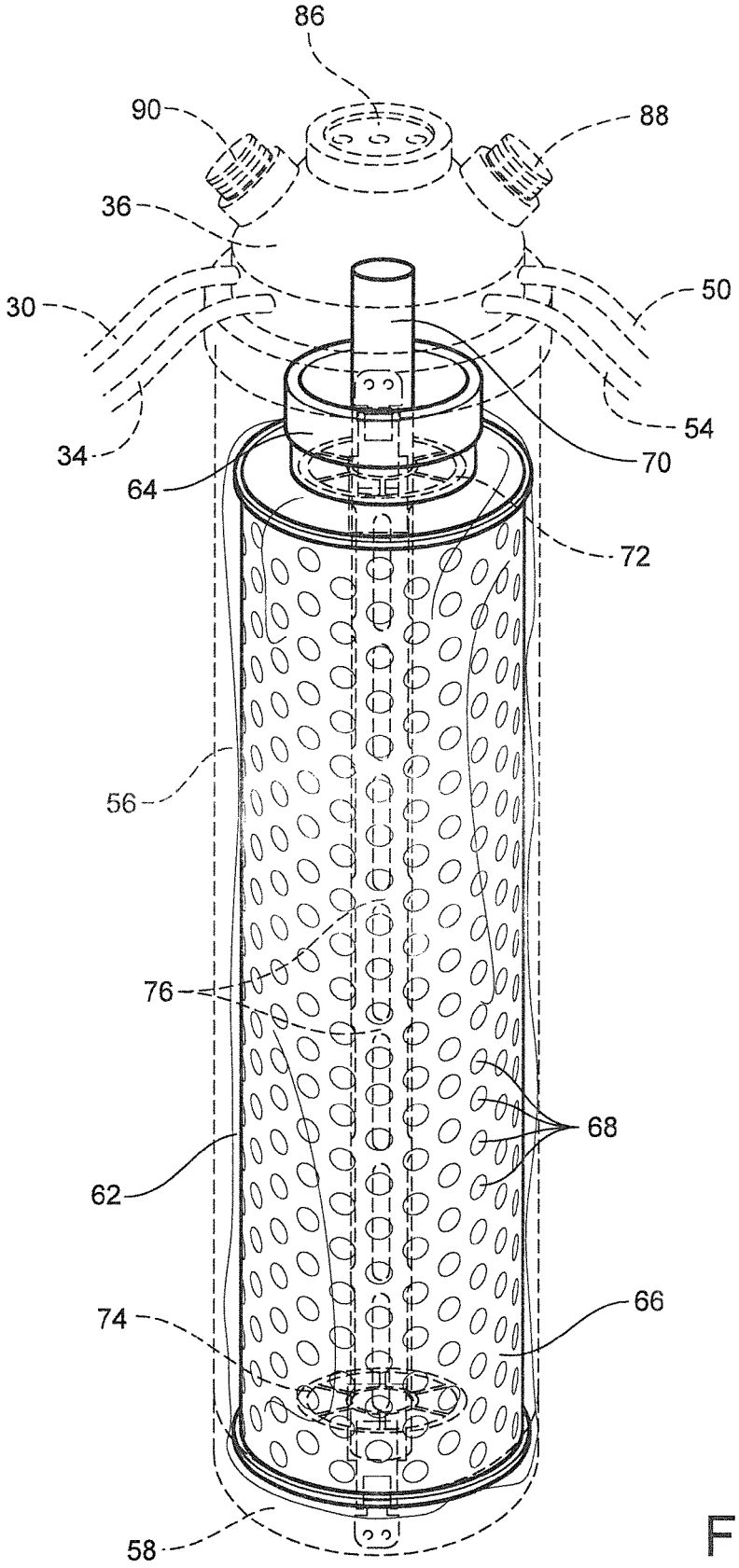
FIG. 7 is an assembled view of the rebreather tank.

The entire volume of the scrubber 66 except for the inner scrubber tube 70 is filled with a carbon dioxide absorbing material, such as soda lime. This material is, for example, sold under the trademark "Sodasorb." This material, which resembles small marbles, acts to retain the exhaled CO2 while allowing the oxygen and other air constituents, such as nitrogen, to pass through the material. As is shown in FIG. 6, when associated with FIGS. 3-5, exhaled air flows through the exhale hose 20 into the inner scrubber tube 70 through a centrally positioned exhale port 80 in the head 36. The exhaled air is pushed by its own pressure through the exhale flow channels 76, through the soda lime, out through the inhale flow holes 68 in the scrubber 66 and into the counterlung 62. CO2 is scrubbed from the air by the chemical action of the soda lime, and the remaining air is inhaled by the diver through an inhale port 82 in the head 36 that communicates with the inhale hose 18. Four oxygen sensors 84 are also contained in the interior of the head 36.

The head 36 is sealed and latched into place on the top of the tank 56. The head 36 includes the Over Pressure Valve (OPV) 86, an inhale inlet 88 for connection to the inhale hose 18, and an exhale outlet 90 for connection to the exhale hose 20. The head 36 also has connections for the inlet hose 30, wiring cable 34, manual add hose 50 and wiring cable 54.

The rebreather may further include in the bottom end 58 adjacent the counterlung a water trap to stop large volumes of water from entering the gas loop in the event the diver removes the mouthpiece underwater without closing the valve, or if the diver's lips get slack letting water leak in. The rebreather may further include temperature sensors located along the length of the scrubber for monitoring the exothermic reaction of the carbon dioxide and soda lime to monitor material life.

While a closed circuit rebreather having an internal counterlung is described herein with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A closed circuit rebreather, comprising:

a breathing hose assembly comprising a breathing mouthpiece, a dive surface valve connected for gas flow with the mouthpiece, a commonly controlled auto demand valve and bail out valve assembly, and an inhale hose and an exhale hose each connected for gas flow with the auto demand valve and bail out valve assembly;

a head assembly comprising a head, an over pressure valve, at least one oxygen sensor, an exhale port connected for gas flow with the exhale hose, and an inhale port connected for gas flow with the inhale hose; and an internal counterlung assembly housed within a tank and having gas flow passageways therethrough, the counterlung assembly comprising a foraminous scrubber assembly substantially enclosed along its longitudinal length within a water impervious counterlung bladder.

2. The rebreather according to claim 1, wherein the scrubber assembly comprises an inner tube having a plurality of longitudinally extending breathing gas flow openings defined therethrough along its length, the inner tube maintained within a concentric position within an outer tube by annular washers to define a volume of space between the inner and outer tubes.

3. The rebreather according to claim 2, wherein at least one surface of the annular washers and substantially the entire longitudinal periphery of each of the inner and outer tubes are covered with a fine mesh screen having openings sized to prevent a carbon dioxide absorbing material from passing therethrough.

4. The rebreather according to claim 2, wherein the volume of space defined between the inner and outer tubes is filled with a carbon dioxide absorbing material.

5. The rebreather according to claim 1, the internal counterlung assembly further comprising sealing flanges at opposing ends of the outer tube for providing sealing engagement between the bladder and the opposing ends of the outer tube.

6. The rebreather according to claim 1, wherein the counterlung assembly comprises axial and radial gas flow passageways therethrough.

7. The rebreather according to claim 1, further comprising a bottom section of the tank comprising a water drain and a water trap.

8. The rebreather according to claim 1, further comprising an oxygen tank for supplying breathing gas and connected for gas flow to the head assembly through an oxygen control valve and inlet hose.

9. The rebreather according to claim 1, further comprising a diluent tank for supplying breathable gas and connected for gas flow to the auto demand and bail out valve assembly through a gas block.

10. The rebreather according to claim 1, further comprising at least one monitor for monitoring the partial pressure of oxygen in the breathing gas.

11. The rebreather according to claim 1, wherein the dive surface valve and auto demand valve and bail out valve assembly are located within a common housing.

12. The rebreather according to claim 1, wherein the internal counterlung assembly is positioned within the rebreather such that it is centrally located to a diver's lungs in either a back- or side-mounted configuration when in use.

13. A closed circuit rebreather, comprising:

a breathing hose assembly comprising a dive surface valve, an auto demand valve and bail out valve assembly controlled through a common knob, and inhale and exhale hoses connected for gas flow with the auto demand valve and bail out valve assembly;

a head assembly comprising an over pressure valve, at least one oxygen sensor, an exhale port connected for gas flow with the exhale hose, and an inhale port connected for gas flow with the inhale hose; and an internal counterlung assembly housed within a tank and having axial and radial gas flow passageways therethrough, the counterlung assembly comprising a foraminous scrubber assembly substantially enclosed along its longitudinal length within a water impervious counterlung bladder.

14. The rebreather according to claim 13, wherein the scrubber assembly comprises an inner tube having a plurality of longitudinally extending gas flow openings defined therethrough along its length, the inner tube being concentrically positioned within a foraminous outer tube such that a volume of space is provided therebetween.

15. The rebreather according to claim 14, wherein the entire overlapping longitudinal periphery of each of the inner and outer tubes are covered with a mesh screen having openings sized to prevent a carbon dioxide absorbing material from passing therethrough.

16. The rebreather according to claim 14, wherein the volume of space defined between the inner and outer tubes is filled with a carbon dioxide absorbing material.

17. The rebreather according to claim 14, further comprising at least one annular washer positioned intermediate the inner and outer tubes for concentrically positioning the inner tube within the outer tube.

18. The rebreather according to claim 14, wherein the foraminous outer tube comprises periodically arranged openings along its length overlapping the inner tube.

19. The rebreather according to claim 13, further comprising an oxygen tank for supplying breathing gas and connected for gas flow to the head assembly through an oxygen control valve and inlet hose, and a diluent tank for supplying breathable gas and connected for gas flow to the auto demand and bail out valve assembly through a gas block.

20. The rebreather according to claim 13, wherein the internal counterlung assembly is positioned within the rebreather such that it is centrally located to a diver's lungs in either a back- or side-mounted configuration when in use.

* * * * *